United States Patent [19]

Häberli

[11] Patent Number: 4,517,899

[45] Date of Patent: May 21, 1985

[54] SABOT PROJECTILE

[75] Inventor: Peter Häberli, Wallisellen, Switzerland

[73] Assignee: Werkzeugmaschinenfabrik Oerlikon-Bührle AG, Zurich, Switzerland

[21] Appl. No.: 420,360

[22] Filed: Sep. 20, 1982

Related U.S. Application Data

[60] Continuation-in-part of Ser. No. 250,944, Apr. 6, 1981, abandoned, which is a division of Ser. No. 060,050, Jul. 23, 1979, Pat. No. 4,351,094.

[30] Foreign Application Priority Data

Aug. 8, 1978 [CH] Switzerland ..... 8404/78

[51] Int. Cl.[3] ..... F42B 13/16

[52] U.S. Cl. ..... 102/521; 102/703

[58] Field of Search ..... 102/520–523, 102/513, 529, 514–517, 703

[56] References Cited

U.S. PATENT DOCUMENTS

| | | | |
|---|---|---|---|
| 3,262,391 | 7/1966 | Shober | 102/521 |
| 3,427,648 | 2/1969 | Manning et al. | 102/523 |
| 3,750,578 | 8/1973 | Blajda | 102/520 X |
| 3,981,246 | 9/1976 | Luther et al. | 102/521 |
| 4,215,632 | 8/1980 | Sie | 102/521 |

*Primary Examiner*—Harold Tudor
*Attorney, Agent, or Firm*—Werner W. Kleeman

[57] ABSTRACT

A sabot projectile comprising a projectile body and a sabot formed of a metal alloy secured at the projectile body. A plastic jacket is secured to the sabot. Mutually interengaging holding means are provided at the projectile body and at the sabot, and said holding means positively interengage free of play with one another for securing the sabot at the projectile body.

14 Claims, 13 Drawing Figures

SABOT PROJECTILE

CROSS REFERENCE TO RELATED APPLICATIONS

This application is a continuation-in-part application of my commonly assigned, copending U.S. application Ser. No. 06/250,944, filed Apr. 6, 1981 now abandoned which, in turn, is a divisional application of my commonly assigned, copending application Ser. No. 06/060,050, filed July 23, 1979, now U.S. Pat. No. 4,351,094.

BACKGROUND OF THE INVENTION

The present invention relates to a new and improved sabot projectile, especially an arrow projectile, comprising a projectile body, a sabot formed of a metal alloy and a plastic jacket.

Sabot projectiles, also referred to in the art as subcaliber projectiles, are used in armor-piercing weapons having extremely high ammunition velocity, also referred to as hypervelocity armor-piercing sabots.

With a state-of-the-art projectile of this type, as the same has been disclosed in Swiss Patent No. 512,719, segments of a sabot are arranged about a projectile needle or arrow. These segments are held together radially by means of a guide band and a sealing band. Between the sabot and the projectile arrow there is arranged an entrainment element for transmitting the forces in axial direction. This entrainment element comprises, for instance, a ring composed of a number of elements and engages both in a groove of the projectile arrow or needle and also in a groove provided at the sabot.

With such type projectile the preparatory work for the injection molding of a plastic jacket is extremely time-consuming, and therefore is unfavorable for any rational and priceworthy mass or series production of the projectile. Thus, the segments of the sabot, the projectile arrow and the entrainment elements must be assembled together and, by means of a special device which holds together such parts, placed into an injection mold. It is therefore possible that during assembly or joining together of the sabot, projectile arrow and entrainment elements, individual parts will become lost, particularly since, with this heretofore known projectile, joints between the segments of the projectile are sealed by ledges or strips against the throughflow of propellant gases. The ledges are inserted into grooves cut into the segments and directed transversely with respect to the lengthwise axis of the projectile.

According to another heretofore known projectile of this type, as disclosed in Swiss Patent No. 536,481, the projectile body protrudes, by means of its rear portion, into a sleeve-shaped projection of the sabot. In the rear portion of the projectile body, there are machined circumferential grooves. In order to secure the sabot at the projectile body there are provided dogs or cams which engage into the circumferential grooves of the projectile body. These dogs or cams are produced by a punch which radially impacts against the sleeve-shaped projection of the sabot. The punch forces material of the sabot, at a number of locations, into the circumferential or peripheral grooves.

With such projectile, there is needed a special working operation for attachment of the projectile body at the sabot. By the same token, also a device must be provided for producing the dogs or cams from the material of the projection of the sabot. However, since these dogs or cams only can engage at a number of places along the circumference of the projectile body at such projectile body, the major part of the circumferential grooves does not contribute to the transmission of the forces between the sabot and the projectile body. The projectile body, fabricated from a heavy metal, unnecessarily experiences a weight reduction by virtue of such continuous grooves, which, in turn, reduces the effectiveness of the projectile.

SUMMARY OF THE INVENTION

Therefore, with the foregoing in mind, it is a primary object of the present invention to provide a new and improved sabot projectile which is not associated with the aforementioned drawbacks and limitations of the prior art proposals.

Another and more specific object of the invention aims at providing a new and improved construction of sabot projectile which is extremely suitable for mass or series production.

Yet a further significant object of the present invention aims at a novel sabot projectile wherein the fabrication costs can be reduced, while adapting the production technique so that it is readily suitable for mass production.

Apart from the foregoing objectives the invention enables realization of still further advantages. More specifically, since the drive connection between the sabot and the projectile body is produced during molding of the sabot, there are markedly reduced the requirements as concerns the accuracy of the region of the projectile body and the sabot which produce the drive connection, without there occurring any axial play. Particularly when fabricating an arrow projectile this feature of the invention enables that, the location at the projectile arrow or needle, where it should be drive connected with the sabot, can be provided quite far forward at the sabot projectile.

After the molding operation the sabot and the projectile body constitute a single piece which can be inserted into a plastic injection mold.

The volume changes arising at the sabot, following the molding operation, during its cooling, ensure that the sabot, in its cold state, tightly or snugly encloses the projectile body. In the case of arrow projectiles, fired from rifled tubes or barrels, this feature constitutes a further advantage inasmuch as there is no longer possible any radial play between the projectile body or projectile arrow and the sabot, and thus, there is appreciably reduced the danger of there occurring any imbalance. This, in turn, means that there is lesser loading of the projectile arrow or needle, by forces acting laterally with respect to the direction of movement of the projectile. This again, in turn, permits increasing the degree of slimness or slenderness of the projectile needle or arrow, which is noticeable by virtue of the increased effectiveness of the projectile.

A further advantage resides in the fact that, the recesses or machined portions, which must be provided for attachment of the sabot at the projectile body, need not extend over the entire circumference of the projectile body. These recesses are only needed to a degree such that they have a counter-element at the sabot, with which they can collectively form a positive connection free of play. Consequently, there is avoided the need to unnecessarily provide recesses which reduce the weight of the projectile body. Again, this leads to increased effectiveness of the projectile.

For instance, instead of providing continuous grooves as attachment locations for the sabot, it is possible to machine, such as by milling, non-circular profiles, also referred to as polygon profiles or sectional shapes, in the projectile body. In contrast to projectile needles or arrows having conventional recesses, in the case of projectile needles or arrows which are processed in this manner, there is increased the critical rotational speed, which in the case of arrow projectiles, fired from spin tubes, is of advantage.

Now in order to implement these and still further objects of the invention, which will become more readily apparent as the description proceeds, the method for the manufacture of a sabot projectile according to the invention, especially an arrow projectile, containing a projectile body, a sabot formed of a metal alloy and a plastic jacket, is manifested by the features that the sabot is directly molded at the projectile body in a first mold, and that in a second mold the pastic jacket is molded at the projectile body and the sabot.

As explained above, the invention also concerns a novel sabot projectile produced according to the aforementioned method aspects. At the projectile body and at the sabot there are provided positively interengaging holder means which coact with one another free of play, i.e. positively interlock or interengage in a form-locking fashion.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various Figures there have been generally used the same reference characters to denote the same or analogous componets and wherein:

FIG. 8*a* is a partially sectional view of part of the projectile body as encircled in FIG. 8 and shows a modified structure of the recesses in the projectile body;

DETAILED DESCRIPTION OF THE PREFERRED EMBODIMENTS

Figure 1:
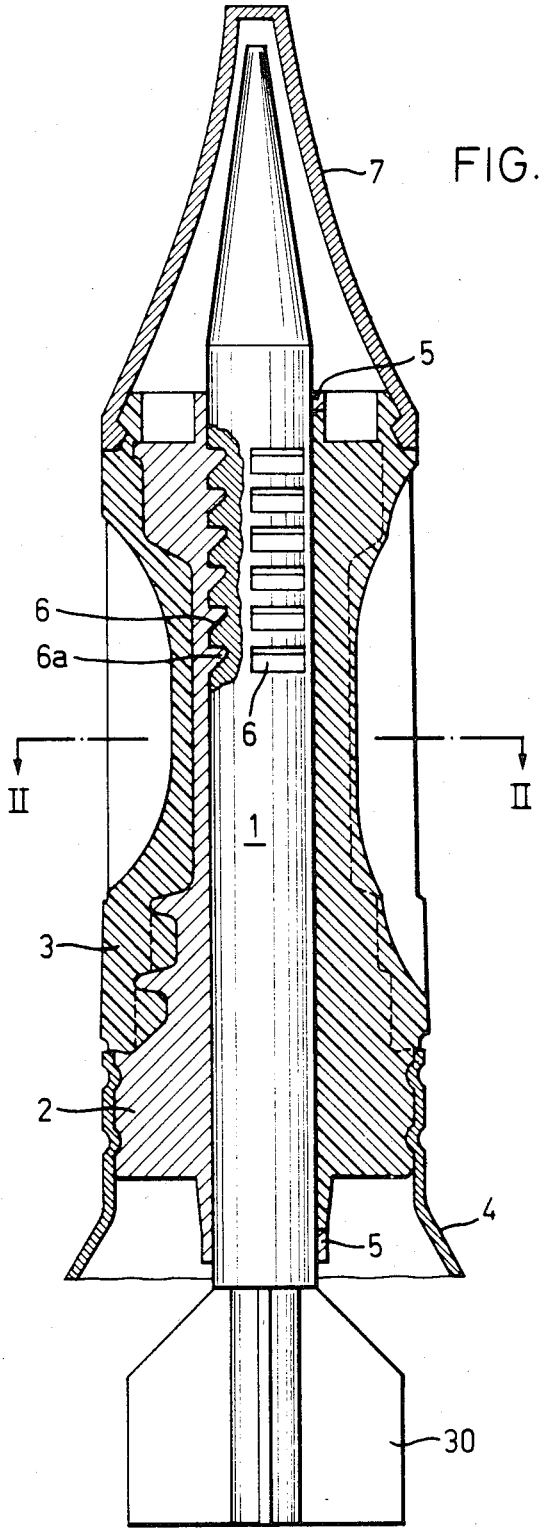
FIG. 1 is a longitudinal sectional view through a sabot projectile, shown here as an arrow projectile, the section being taken substantially along the line I—I of FIG. 2.

Describing now the drawings, according to the showing of FIG. 1 there is illustrated a sabot or arrow projectile, fabricated according to the inventive method, and formed in the following manner:

A projectile needle—sometimes referred to as a projectile arrow—or a projectile body 1 is surrounded by a sabot 2 and a plastic jacket 3. At its front end the plastic jacket 3 carries a ballistic hood 7. The projectile extends rearwardly into a cartridge sleeve 4 or equivalent structure. As best seen by referring to FIG. 2, the sabot 2 is divided into a number of segments 2*a* formed of a suitable metal alloy. These segments 2*a* are interconnected at both ends by means of holders or holder means, constructed as rings or ring members 5, as best seen by referring to FIGS. 1, 5 and 6. The projectile needle or arrow 1 comprises, as its holding or holder means, for instance recesses 6, into which engage holding or holder means formed at the sabot 2, these last-mentioned holder means being constructed as dogs or cams 6*a* and serve to transmit the forces arising between the sabot 2 and the projectile needle or arrow 1.

Figure 2:
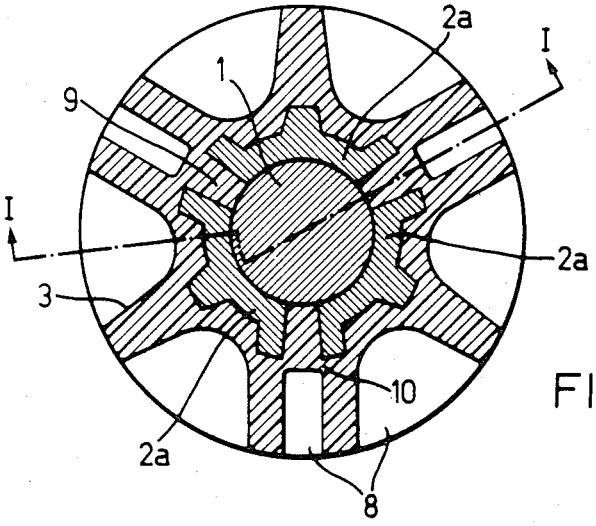
FIG. 2 is a cross-sectional view through the projectile of FIG. 1, taken substantially along the line II—II thereof.

By referring to FIG. 2, it will be recognized that the sabot 2 is surrounded by a jacket 3 which is provided, at its circumference or periphery, with numerous recesses or depressions 8 or equivalent structure, contributing to a saving in weight of the sabot projectile. These recesses 8 are distributed such that there are formed a number of reference fracture locations 10 corresponding to the number of segments 2*a* of the sabot 2.

By again referring to FIGS. 5 and 6 there will be seen details of the rings or ring members 5 which interconnect the segments 2*a* of the sabot 2 and retain such segments 2*a* upon the projectile body 1. The intermediate gaps or slots 9 separate the individual segments 2*a* of the sabot projectile 2 from one another.

Figure 7:
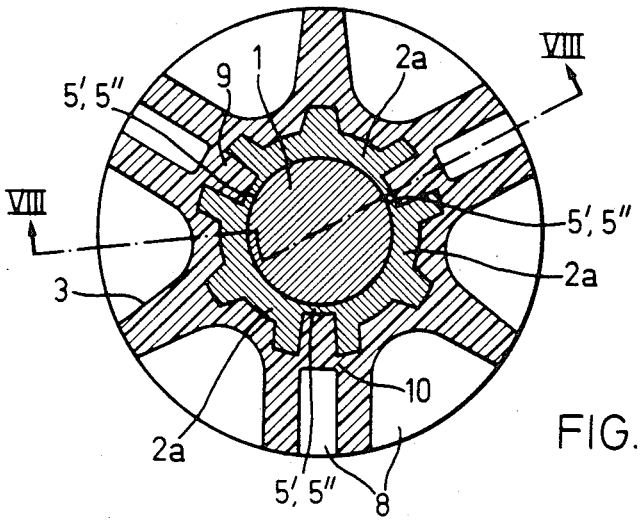
FIG. 7 is a cross-sectional view through the sabot projectile shown in FIGS. 8 and 9, taken substantially along the section line VIII—VIII thereof.
Figure 8:
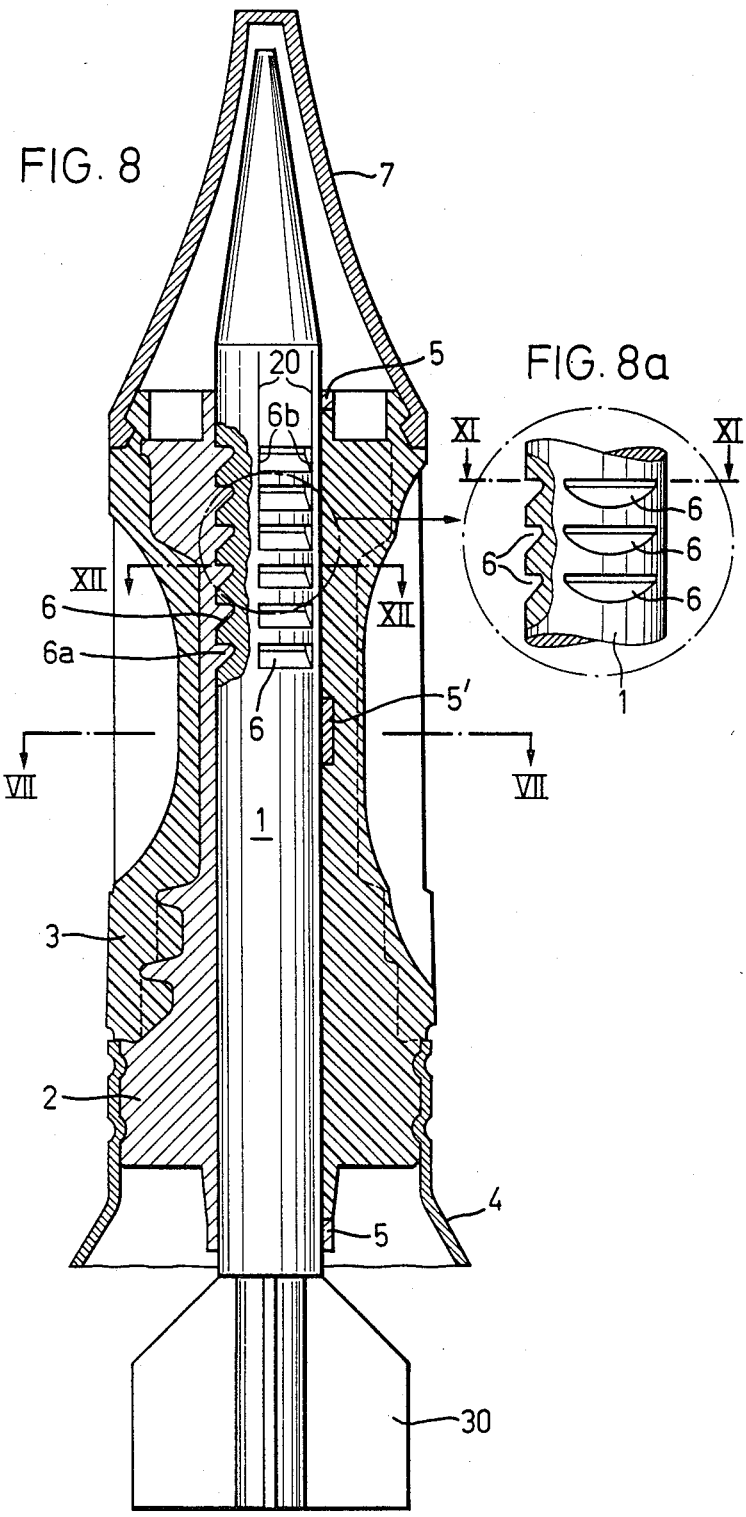
FIGS. 8 and 9 constitute respective longitudinal sectional views depicting modified constructions of the sabot projectile depicted in FIG. 1.
Figure 9:
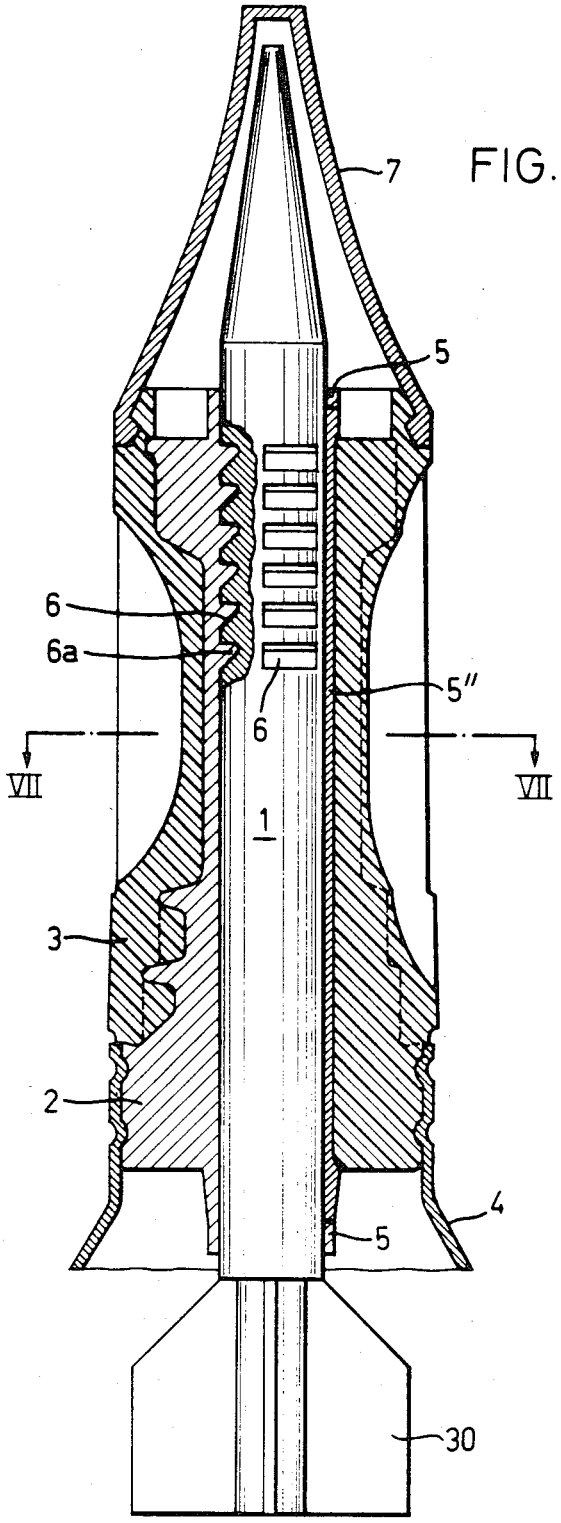

In addition to the rings or ring members 5 at the ends of the sabot 2 it will be understood that there can be arranged a further ring or ring member 5' between the rings 5, as best seen by referring to the construction of sabot projectile depicted in FIG. 8. Equally, a ring or ring member 5'', as shown for the construction of sabot projectile depicted in FIG. 9, can be arranged over the entire length of the sabot 2 between the rings or ring members 5 located at the opposite end regions of the sabot projectile. With the solutions according to the arrangements shown in FIGS. 8 and 9, the segments 2*a* of the sabot projectile 2 are interconnected with one another by the thin rings 5' or 5'', as also shown in sectional view in FIG. 7.

As to the recesses 6 there are particularly suitable different constructional embodiments. From FIGS. 1, 8 and 9 there will be recognized the recesses 6 which, viewed in the circumferential direction, posses boundary surfaces 6*b* (FIGS. 8 and 9) which secure the projectile body 1 and the sabot 2 against relative rotation. As shown in FIG. 8 these boundary surfaces 6*b* are preferably located in planes 20 which simultaneously constitute radial planes or planes extending parallel to a radial plane defined by the basically cylindrical projectile body 1.

Figure 10:
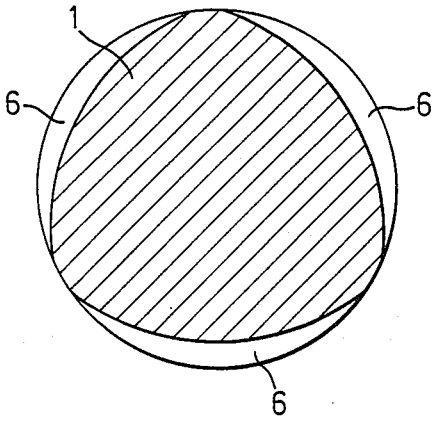
FIGS. 10 and 11 are respective cross-sectional views through the projectile body showing further possible modifications in the design of the sabot projectile.
Figure 11:
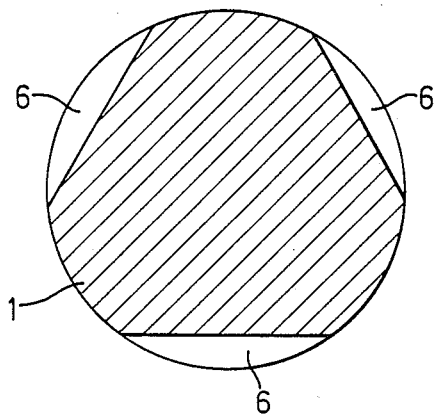
Figure 12:
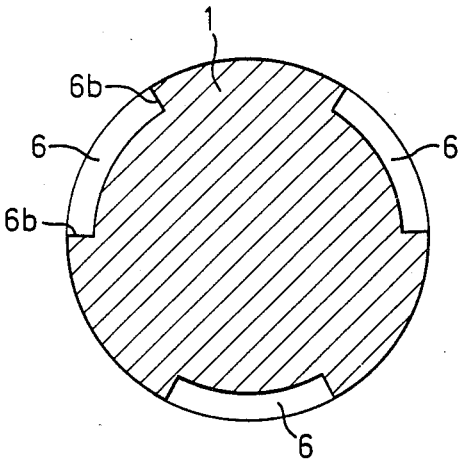
FIG. 12 is a cross-sectional view through the projectile body as shown in FIG. 8 along the line XII—XII.

FIGS. 10 and 11 each depict a sectional view transversely through the projectile body 1 at the location of the recesses 6. In this case these recesses 6 do not possess any lateral boundary surfaces. The particular shape of the projectile body 1 at this location constitutes a so-called polygon profile or sectional shape and likewise secures the projectile body 1 and the sabot 2 against relative rotation, provided that the here not particularly illustrated dogs or cams 6*a* at the sabot 2 completely fill the recesses 6. These recesses 6 will be seen to possess a varying non-constant depth viewed in the circumferential direction of the projectile body 1 as also shown in FIG. 8*a*.

Now with the benefit of the foregoing, there will be considered hereinafter the inventive method of manufacturing such sabot projectiles which essentially comprises the following steps.

Initially, there is formed in conventional fashion a projectile needle or body 1. This projectile needle or body 1 is manufactured from a standard sintered tungsten alloy as is known in this art.

Figure 3:
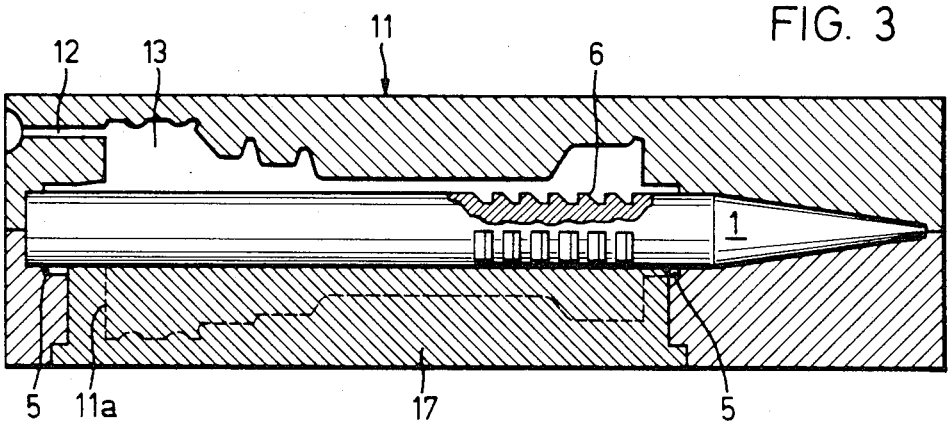
FIG. 3 is a longitudinal sectional view illustrating a simplified showing of a mold for a sabot.
Figure 5:
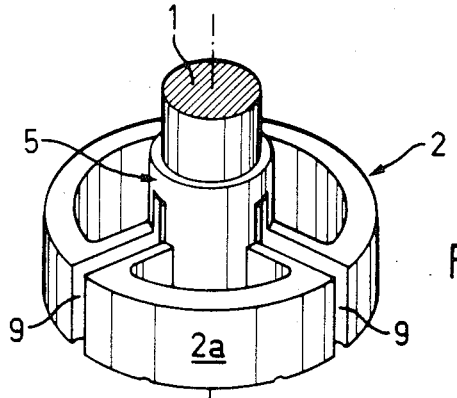
FIG. 5 illustrates in perspective view details of the upper portion of the sabot projectile.
Figure 6:
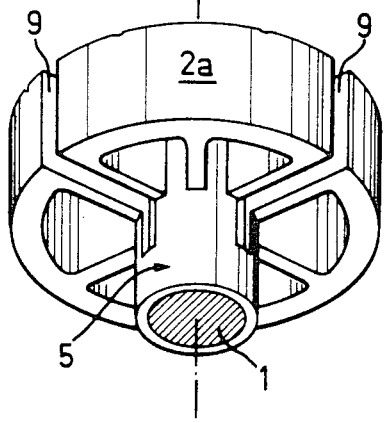
FIG. 6 likewise illustrates in perspective view details of the lower portion of the sabot projectile.

During a second step, there is fabricated the sabot 2. For this end there is needed a multi-part mold 11 as shown in FIG. 3, by way of example. This multi-part mold 11 is structured such that it can receive, as the core, the projectile needle or arrow 1. It is composed of a number of segments, generally indicated by reference character 11*a*, corresponding to the number of segments 2*a* of the sabot 2. Each of the segments 11*a* of the mold or mold assembly 11 is provided, in conventional fashion, with a slide 17 or equivalent structure. These slides or slide members 17, when the mold 11 is closed, are radially shifted against the projectile needle or arrow 1, so that during the molding operation there are formed the intermediate slots or gaps 9 (FIGS. 2, 5 and 6). Upon insertion of the projectile needle or arrow 1 into the mold 11 care must be taken that none of the recesses 6 is located below the contact surface of the slide 17. To mold the sabot 2, a liquid metal alloy is injected into the mold cavity or compartment 13 by means of an opening 12, as best seen by referring to FIG. 3. This liquid metal alloy typically may comprise, by way of example and not limitation, a light metal aluminium pressure cast alloy, such as commercially available from the well-known Swiss firm, Alusuisse company, under its trademark "UNIFONT". During this molding or casting operation there are also molded or cast the dogs or cams 6*a* and the rings 5. After cooling, the sabot 2 together with the projectile needle or arrow 1 can be removed from the mold 11 as a single or integrated piece.

Figure 4:
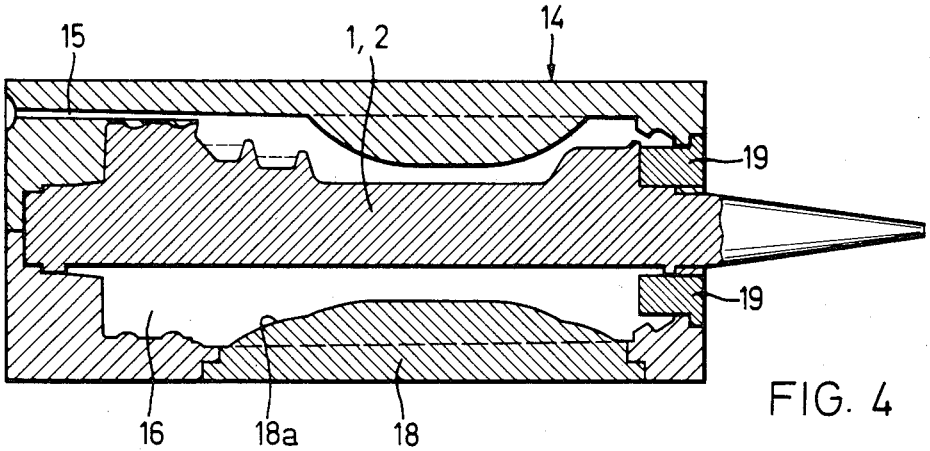
FIG. 4 is a longitudinal sectional view, in a simplified illustration, through a mold for a plastic jacket.

A further step of the inventive method constitutes fabricating the plastic jacket 3 which may be formed of any suitable plastics material, typically polyamide, such as commercially available from the well-known United States firm, DUPONT company, under its commercial designation or mark "NYLON 6/6". The assembly, composed of the projectile needle or arrow 1 and the sabot 2, again is introduced, as a core, into a second mold 14, as best seen by referring to FIG. 4. The second mold 14 likewise comprises a number of segments, generally indicated by reference character 18*a*, corresponding to the number of segments 2*a* of the sabot 2, these segments likewise being provided in conventional manner with the slides or slide members 18 in order to produce at least a part of the recesses or depressions 8. Further slides or slide members 19 are arranged at each segment of the mold 14 so as to be axially insertable. An opening 15 flow communicates a hollow cavity or compartment 16, which is to be filled with the plastic molding material, for instance with the aid of an injection molding apparatus. During molding the gaps or spaces 9 between the individual segments 2*a* of the sabot 2 are sealed by the plastic jacket 3. After the subsequent cooling of the jacket 3 there is removed from the mold 14 again a unit composed of the projectile needle or arrow 1, sabot 2 and plastic jacket 3. The rings or ring members 5 now can be split-open or machined-off as by a lathing operation, in order to provide for better detachment of the sabot segments 2*a* upon exit of the sabot projectile out of the firing weapon barrel or tube, and the hood 7 and tail stabilizing fins 30 then can be subsequently mounted.

While there are shown and described present preferred embodiments of the invention, it is to be distinctly understood that the invention is not limited thereto, but may be otherwise variously embodied and practised within the scope of the following claims. ACCORDINGLY,

I claim:

1. A sabot projectile comprising:

a projectile body;

a sabot composed of a number of segments formed of a metal alloy and secured at the projectile body;

said segments circumferentially enclosing part of said projectile body with gaps formed between circumferentially adjacent ones of said segments;

a plastic jacket surrounding the sabot segments and protruding into said gaps;

said projectile body being provided with a plurality of recesses;

each said recess of said projectile body possessing lateral boundary surfaces which delimit said recess in the circumferential direction of the projectile body;

said sabot segments of said sabot comprising cam means;

said cam means completely filling the recesses at the projectile body and securing the sabot at the projectile body against rotation; and said sabot comprising ring members which directly enclose the projectile body and bridges said gaps formed between said circumferentially adjacent segments by interconnecting the sabot segments with one another.

2. The sabot projectile as defined in claim 1, wherein:

said ring members are arranged at opposite end regions of the sabot.

3. The sabot projectile as defined in claim 1, wherein:

said ring members are arranged at a number of locations along the lengthwise extent of the projectile body.

4. The sabot projectile as defined in claim 1, wherein:

said recesses are distributively arranged in axial rows over the circumference of the projectile body and which rows correspond in number to the number of segments of the sabot.

5. The sabot projectile as defined in claim 1, wherein:

said lateral boundary surfaces of the recesses are located in substantially radial planes.

6. The sabot projectile as defined in claim 1, wherein:

said projectile body defines a substantially cylindrical structure and radial planes extending through said substantially cylindrical structure; and each one of said lateral boundary surfaces of the recesses is located in a plane which extends substantially parallel to a predetermined one of said radial planes.

7. The sabot projectile as defined in claim 6, wherein:

said recesses are arranged in a predetermined number of series along the projectile body; and said predetermined number of series corresponds to the number of segments of the sabot.

8. The sabot projectile as defined in claim 5, wherein:

said recesses are arranged in a predetermined number of series along the projectile body; and said predetermined number of series corresponds to the number of segments of the sabot.

9. The sabot projectile as defined in claim 1, wherein:

said ring members extend over substantially the entire length of the sabot.

10. The sabot projectile as defined in claim 1, wherein:

said recesses of the projectile body are only provided at a front region thereof which is situated closer to a front end of said projectile body than its rear end.

11. The sabot projectile as defined in claim 1, wherein:

said plurality of recesses are distributively arranged over the circumference of the projectile body.

12. The sabot projectile as defined in claim 1, wherein:

said recesses at the projectile body extend across a predetermined part of the circumference of the projectile body and merge with said circumference of said projectile body in both circumferential directions.

13. The sabot projectile as defined in claim 1, wherein:

said recesses of said projectile body possess a varying depth viewed in the circumferential direction of the projectile body.

14. The sabot projectile as defined in claim 1, wherein:

said plastic jacket which protrudes into said gaps forms reference fracture locations at the region of said gaps.

* * * * *